US007862629B2

(12) United States Patent
Gaughan et al.

(10) Patent No.: US 7,862,629 B2
(45) Date of Patent: Jan. 4, 2011

(54) LEADED AVIATION GASOLINE

(75) Inventors: Roger Grant Gaughan, Sewell, NJ (US); William S. Blazowski, Forked River, NJ (US); Daniel Dawson Lowrey, Westville, NJ (US); Thomas Mack Bell, Baytown, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1494 days.

(21) Appl. No.: 11/104,151

(22) Filed: Apr. 12, 2005

(65) Prior Publication Data

US 2005/0229480 A1 Oct. 20, 2005

Related U.S. Application Data

(60) Provisional application No. 60/562,878, filed on Apr. 15, 2004.

(51) Int. Cl.
*C10L 1/22* (2006.01)

(52) U.S. Cl. ..... 44/412

(58) Field of Classification Search ..... 44/412
See application file for complete search history.

(56) References Cited

U.S. PATENT DOCUMENTS

| | | | | |
|---|---|---|---|---|
| 1,592,953 | A | 7/1926 | Midgley, Jr. | |
| 1,605,663 | A | 11/1926 | Kettering et al. | |
| 1,606,431 | A | 11/1926 | Hamby et al. | |
| 2,398,197 | A | 4/1946 | Stanly | 44/74 |
| 2,413,262 | A | 12/1946 | Stirton | 44/69 |
| 2,434,650 | A | 1/1948 | Herbst | 44/74 |
| 2,819,953 | A | 1/1958 | Brown et al. | 44/74 |
| 3,212,867 | A * | 10/1965 | Ockerbloom | 44/401 |
| 4,294,587 | A | 10/1981 | Burns | 44/74 |
| 4,295,862 | A | 10/1981 | Burns | 44/72 |
| 4,321,063 | A | 3/1982 | Burns | 44/74 |
| 4,417,904 | A | 11/1983 | Burns et al. | 44/72 |
| 5,141,524 | A | 8/1992 | Gonzalez | 44/340 |
| 5,316,558 | A | 5/1994 | Gonzalez | 44/340 |
| 5,470,358 | A | 11/1995 | Gaughan | 44/426 |
| 5,851,241 | A | 12/1998 | Studzinski et al. | 44/359 |
| 6,258,134 | B1 | 7/2001 | Studzinski et al. | 44/359 |
| 2002/0055663 | A1 | 5/2002 | Barnes et al. | 585/14 |

OTHER PUBLICATIONS www.statemaster.com/encyclopedia/Avgas 2003.*

* cited by examiner

*Primary Examiner*—Cephia D Toomer

(57) ABSTRACT

Aviation gasolines having an enhanced peak indicated mean effective pressure are provided by admixing with a leaded base aviation gasoline an aromatic amine of the formula $NH_2$—Ar—$(R^1)_n$ wherein $R^1$ is selected from $C_1$-$C_{10}$ alkyl, halogen, and mixtures thereof provided that when $R^1$ is alkyl it occupies the meta- or para-positions on the aromatic ring, Ar is a phenyl aromatic group and n is an integer from 0 to 3 to provide an aviation gasoline having a peak indicated mean effective pressure as determined by ASTM D-909 of greater than about 200 psi.

11 Claims, 3 Drawing Sheets

LEADED AVIATION GASOLINE

This application claims the benefit of U.S. Ser. No. 60/562,878 filed Apr. 15, 2004.

FIELD OF THE INVENTION

This invention relates to aviation gasolines. More specifically, this invention is directed to an aviation gasoline possessing both a high motor octane number and a high peak indicated mean effective pressure for use in piston driven aircraft which require high octane fuels.

BACKGROUND OF THE INVENTION

The high octane requirements of aviation gas for use in piston driven aircraft which operate under severe requirements, e.g., aircraft containing turbo charged piston engines require that commercial aviation fuels contain a high performance octane booster. The organic octane boosters for automobile gasolines (Mogas) such as benzene, toluene, xylene, methyl tertiary butyl ether, ethanol and the like are not capable by themselves of boosting the motor octane number (MON) to the 98 to 100 MON levels required for aviation gasolines (Avgas). Tetraethyl lead (TEL) is therefore a necessary component in high octane Avgas as an octane booster. However, environmental concerns over lead and its compounds may require the phasing out of lead in Avgas.

U.S. Pat. No. 2,819,953 describes aromatic amines added to motor gasolines as antiknock agents. However, motor gasolines have much lower octane requirements than aviation gasolines for piston driven aircraft. One cannot predict performance of a given antiknock agent in an aviation gasoline based on its performance as an antiknock agent in a motor gasoline.

U.S. Pat. No. 1,605,663 describes the addition of aniline to kerosene or gasoline motor fuels of the 1920's to increase the critical compression pressure of the fuel. The aniline can be added as such or mixed with other substances such as amyl alcohol, amyl acelate and orthotoluidine. When added to automobile engine fuel, the critical compression pressure may be increased to a point between the normal critical compression pressure of the untreated fuel and 160 or more pounds. The patent recites that the invention can be employed in aircraft construction by treating the common forms of aviation gasoline (of the 1920's) which were employed at the time in engines having a compression pressure of about 125 pounds to permit the increase of the compression pressure of the aircraft engines and thus increase their efficiency. In addition to aniline, other amino compounds are recited including xylidine, orthotoluidine, meta toluidine, cumidine, monopropyl aniline, mono-butyl aniline.

U.S. Pat. No. 1,592,953 describes the treatment of motor fuels such as kerosene and gasoline by adding a knock suppressing substance to increase the critical compression pressure of the fuel. The knock suppressing substance is employed in the form of a pellet or pill. The patent describes a pill or pellet of a 50/50 mixture of TEL in para-toluidine in a paraffin shell. Both TEL and para-toluidine exhibit knock suppressing properties but the use of a para-toluidine as the solids producing agent is not critical to the invention.

U.S. Pat. No. 2,434,650 describes a motor fuel particularly high anti-knock aviation engine fuel of 1943 comprising gasoline hydrocarbon, a knock reducing amount of aromatic amine, a gum inhibiting amount of alkylated hydroxy aromatic oxidation inhibitor free from any amine substituents and a sufficient amount of carbon disulfide to stabilize the aromatic amine present in said fuel against discoloration during storage. The amines employed include the xylidines, the toluidenes, aniline, as well as derivatives of aniline in which either or both of the hydrogens on the amines group are substituted by hydrocarbons. The invention of U.S. Pat. No. 2,434,650 also contemplates the use of metallo-organic anti-knock agents, typically and especially tetraethyl lead (TEL) particularly in preparing high octane aviation motor fuels. In the Examples the fuel comprises 50% naphtha base stock of 75 octane number, 49% high anti-knock hydrocarbon blending agent (alkylate) of 91 octane number, 4 cc TEL/gal and 1% xylidine (mixture of isomers).

U.S. Pat. No. 2,413,262 teaches that the addition of small amounts of primary aromatic amines to aviation-type gasolines of extremely high anti-knock value and containing relatively large amounts of TEL has a definite beneficial effect on the anti-knock characteristics of the fuel so treated. Aviation gasolines having high anti-knock performance are described comprising base aviation gasoline and (a) 0.5 to about 15% of an amine having 7 to 12 carbons of the structure:

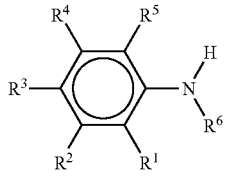

in which $R^1$ to $R^6$ inclusive are selected from the group consisting of hydrogen, phenyl, and saturated alkyl; (b) about 1-10 ml/gal of TEL, the TEL additized fuel having an anti-knock rating at least equal to that of 2,2,4-trimethyl pentane (iso octane). Amines include cymidine, p-cumidine, xylidines, with the meta- and para-xylidine being most effective in enhancing the anti-knock qualities of the gasolines containing the aromatic amines. Base fuels have octanes by the CFR motor method of about 75 or above and are suitable for use in high compression internal combustion engines. The formulated/additized fuel has an octane rating of 100+.

U.S. Pat. No. 2,398,197 describes aromatic amine containing gasolines which also contain minor amounts of certain ketones. Aviation gasoline containing aniline or an alkyl aniline plus minor amounts of methyl propyl ketone or methyl isobutyl ketone is identified. The aviation gasoline may contain up to about 6 cc/gal of TEL.

U.S. Pat. No. 1,606,431 describes a motor fuel comprising gasoline (of 1922), benzol and anilene, the aniline being homogeneously blended in the fuel, the aniline being employed at between 0.75 to 1.50 vol %. The level of treatment is not sufficient to boost the low MON aviation gasoline of the 1920's to a MON to 100+.

U.S. Pat. No. 4,321,063 describes liquid hydrocarbon fuels containing anti-knock quantities of benzylic amine compounds. The gasoline is typical automotive gasoline of low motor octane number. Benzylic amine compound will not boost MON of aviation fuel to 100+.

U.S. Pat. No. 4,294,587 describes a liquid hydrocarbon fuel composition containing anti-knock quantities of N-allylic aromatic amines. The gasoline typical automotive gasoline of low motor octane number. N-allylic aromatic amines will not boost MON of aviation fuel to 100+.

In the cited references, critical compression pressure is the maximum cylinder design pressure for which a fuel may be used without knocking. The pressure is tested without the use of fuel. The references focus on maximum fuel efficiency through lean (low fuel-air ratio) operation.

The indicated mean effective pressure (IMEP) achieved according to ASTM D909 by running the fuel as taught in the present case is a measure of the power output attainable by running a rich mixture and is reported in the test in psi. Peak indicated mean effective pressure (PIMEP) is the maximum power output point, and is achieved by varying the air-fuel ratio. The PIMEP in this case is not reliably predicted by the lean fuel-air ratio results as reported in the prior art as critical compression pressure.

It would be desirable to find an additive system for Avgas that will permit formulation of a high octane Avgas having an improved peak IMEP according to ASTM D-909.

SUMMARY OF THE INVENTION

Figure 1:
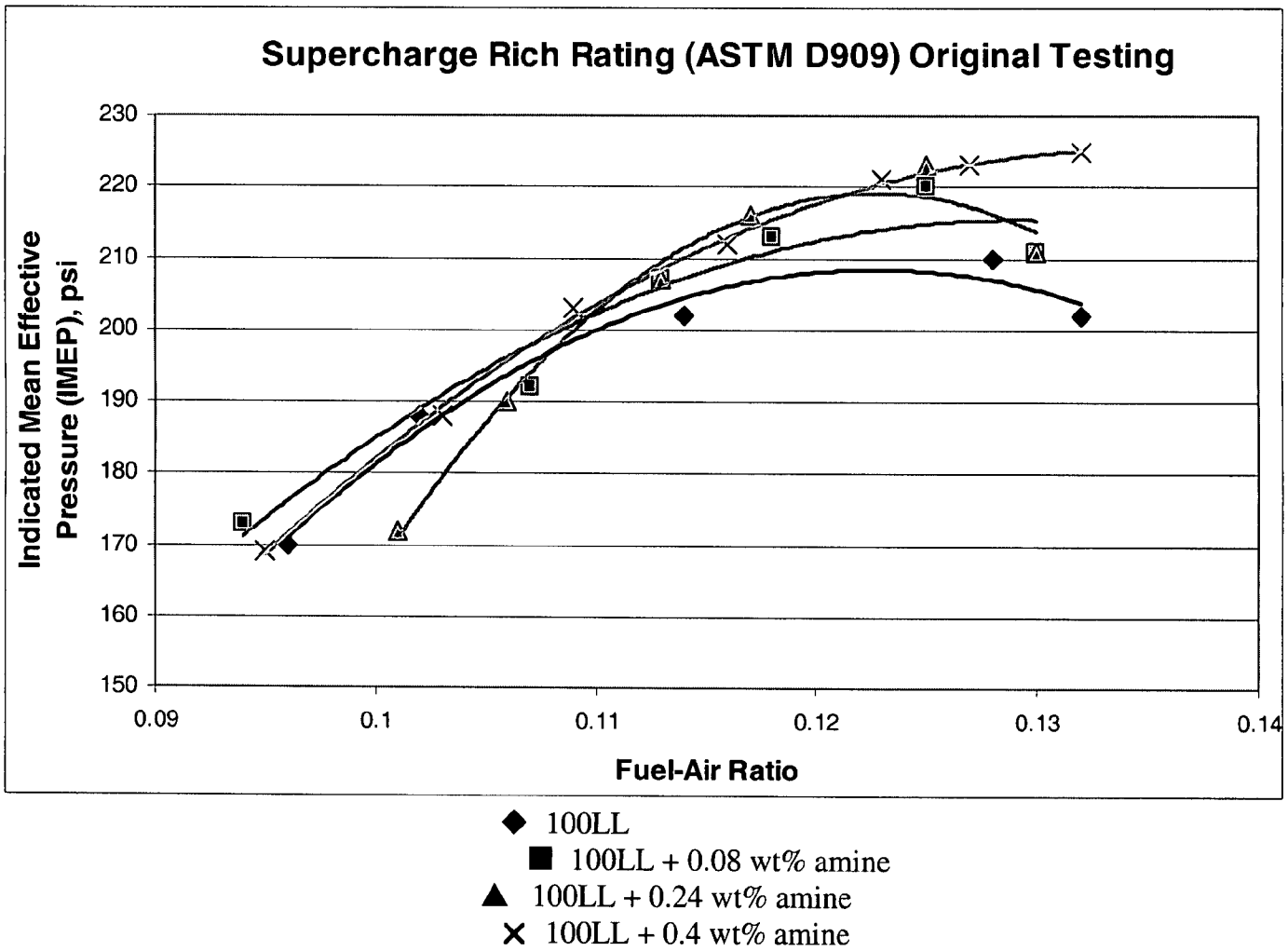
FIG. 1 is a presentation of the indicated mean effective pressure of four comparative fuels using actual aviation fuel as base fuel showing that the fuels containing lead plus amine exhibit peak indicated mean effective pressures higher than that of the leaded base fuel at high fuel-air ratios (rich).

In accordance with the present invention, there is provided a high octane Avgas which has an enhanced peak indicated mean effective pressure. More particularly, this invention relates to an aminated leaded aviation fuel composition having a motor octane number of at least about 98, preferably at least 100, and a peak indicated mean effective pressure (PIMEP) measured by ASTM D909 greater than about 200 psi, preferably greater than about 205 psi, more preferably greater than about 210 psi, most preferably greater than about 215 psi, for piston driven aircraft which comprises:

(1) an aviation gasoline base fuel having an unadditized, unleaded MON of at least 90, preferably 90-97, more preferably 91-95, a lead-containing octane improver producing a leaded aviation gasoline containing between about 0.01 to about 1.25 gms lead per liter, preferably between about 0.013 to 0.6 gms lead per liter; and (2) an amount of at least one aromatic amine effective to boost the peak indicated mean effective pressure and measured by ASTM D909 by at least 1 psi, preferably at least 2 psi, more preferably a at least 5 psi, most preferably at least 10 psi above the PIMEP of the leaded but un-aminated base fuel, said aromatic amine having the formula $$NH_2—Ar—(R^1)_n \quad (I)$$

wherein $R^1$ is selected from the group consisting of $C_1$-$C_{10}$ alkyl, halogen and mixtures thereof, Ar is a phenyl group and n is an integer from 0 to 3 with the proviso that when $R^1$ is alkyl it is positioned in the meta- and/or para-position(s) on the aromatic ring. Another embodiment of the invention comprises a method for preparing a leaded aviation fuel composition having a motor octane number of at least 98, preferably 100+, for use in piston driven aircraft and having a PIMEP at least as recited above which comprises adding an effective amount of aromatic amine described above to the leaded aviation base fuel. Yet another embodiment relates to a method for operating a piston driven aircraft with a leaded fuel which comprises operating the piston driven aircraft with a leaded aviation base fuel containing an amount of at least one aromatic amine of the formula (I) effective to boost the PIMEP as measured by ASTM D909 of the leaded base fuel by at least 1 psi, preferably 2 psi, more preferably at least 5 psi, most preferably at least 10 psi above the PIMEP of the leaded but unaminated base fuel.

DETAILED DESCRIPTION OF THE INVENTION

Compositionally, modern Avgas is different from Mogas, and is even different than the Avgas of the 1920-1930's which was basically leaded Mogas, a fuel having an unleaded MON of only around 50-60. Modern Avgas, because of its higher octane and stability requirements, is currently a blend of isopentane, alkylate, toluene and tetraethyl lead. A typical modern Avgas base fuel without octane booster such as tetraethyl lead has a MON of 90 to 97. Mogas, which has lower octane requirements, is a blend of many components such as butane, virgin and rerun naphtha, light, intermediate and heavy cat naphthas, reformate, isomerate, hydrocrackate, alkylate, ethers and alcohols. Octane requirements of Mogas are based on research octane numbers (RON). For a given fuel, the RON is on average 10 octane numbers higher than its corresponding MON. Thus, the average premium Mogas possesses a MON of 86 to 88, whereas current Avgas must have a MON of 99.5. MON, not RON, is the accepted measure of octane for Avgas and is measured using ASTM D2700-92.

Conventional octane boosters for Mogas, such as benzene, toluene, xylene, methyl tertiary butyl ether and ethanol are capable of boosting the MON of unleaded Avgas to the 92 to 95 MON range if added to Avgas in high enough concentrations. As noted previously, this is insufficient to meet the needs of 99.5 octane high octane Avgas.

The aromatic amines of the present invention are capable of boosting the MON of leaded Avgas from base values of about 90-97, to values of 98 or greater, preferably 100+. In the aromatic amines of the formula $NH_2—Ar—(R^1)_n$, $R^1$ is selected from the group consisting of $C_1$-$C_{10}$ alkyl, halogen and mixtures thereof, Ar is a phenyl aromatic group and n is an integer from 0 to 3, $R^1$ is preferably $C_1$-$C_5$ alkyl or halogen and n is preferably 1 to 2. Preferred halogens are Cl or F. When $R^1$ is alkyl, it occupies the −3, −4, or −5 (meta and/or para) positions on the benzene ring. Alkyl groups in the 2- or 6-position result in aromatic amines which cannot boost octane to a MON value of 98. Examples of preferred aromatic amines include phenylamine, 4-tert-butylphenylamine, 3-methylphenylamine, 3-ethylphenylamine, 4-methylphenylamine, 3,5-dimethylphenylamine, 3,4-dimethylphenylamine, 4-isopropylphenylamine, 2-fluorophenylamine, 3-fluorophenylamine, 4-fluorophenylamine, 2-chlorophenylamine, 3-chlorophenylamine and 4-chlorophenylamine. Especially preferred are 3,5-dimethylphenylamine, 3,4-dimethylphenylamine, 2-fluorophenylamine, 4-fluorophenylamine, 3-methylphenylamine, 3-ethylphenylamine, 4-ethylphenylamine, 4-isopropylphenylamine and 4-t-butylphenylamine.

The peak indicated mean effective pressure of an aviation fuel may be determined by ASTM D-909.

The lead-containing octane booster may comprise tetraethyl lead, ethylene dibromide and an anti oxidant and dye. The lead-containing octane booster may be added in a solvent such as toluene or alkylate.

The fuel compositions of this invention may be prepared by blending in any order aviation base gasoline with (a) a lead-containing octane booster and (b) aromatic amines of the formula (I). It is important that the aromatic amine and the lead-containing octane booster be soluble in aviation gasoline at the desired concentration. Preferred concentrations of the lead-containing octane booster are between about 0.01 to 1.25 gms lead per liter of gasoline, preferably about 0.013 to 0.6 gms lead per liter of gasoline. Preferred concentrations of the aromatic amines are from about 0.05-6 wt %, based on fuel, more preferably about 0.05-1 wt % and most preferably about 0.08-0.4 wt %. It is important that the aromatic amine be soluble in aviation gasoline at the desired concentration. A cosolvent may be added to the Avgas to improve solubility properties. Examples of cosolvents include low molecular weight aromatics, alcohols, nitrides, esters, halogenated hydrocarbons, ethers and the like.

The present aromatic amine additives may be used with conventional octane boosters, such as ethers, alcohols, aromatics and non-lead metals. Examples of such octane boosters include ethyl tertiary butyl ether, methylcyclopentadienyl manganese tricarbonyl, iron pentacarbonyl, as well as the other non-lead containing boosters noted previously. While such conventional metal free organic octane boosters may be used to increase the MON of Avgas, they are not capable by themselves of boosting the MON to the 100 level required in Avgas for use in piston driven engines. The non-lead metal containing additive such as manganese tricarbonyl and iron pentacarbonyl while capable of boosting octane to 100+ are marked by exhibiting adverse effects and properties at the high dosing levels need to reach that level. Adding the aromatic amines of this invention to Avgas containing such other conventional octane booster has only a very slight incremental effect at the 98 MON octane level. Thus there is little economic incentive to combine the present aromatic amines with such other non-lead conventional octane boosters even though technically this can be done.

Other approved additives may be included in the Avgas fuel compositions. Examples of such approved additives include antioxidants and dyes. Approved additives for Avgas are listed in ASTM D-910.

EXAMPLES

Example 1

100 low lead (100 LL) fuel (component A) a standard aviation fuel containing about 0.53 ml TEL per liter (~0.56 g lead/liter) was employed as the base fuel and evaluated for indicated mean effective pressure according to ASTM D909 alone and in combination with varying amounts of alkylate containing 8 wt % m-toluidine (component B) as indicated below:

| Volume % Blends of Components A and B | | | |
|---|---|---|---|
| Sample | Component A | Component B | Wt % Amine |
| 1 | 100 | 0 | 0 |
| 2 | 99 | 1 | 0.08 |
| 3 | 97 | 3 | 0.24 |
| 4 | 95 | 5 | 0.40 |

The results are presented in FIG. 1. As is seen, the samples containing the amine component exhibited PIMEP in excess of that exhibited by the leaded fuel per se, the difference being most pronounced at high fuel-air ratios (rich).

Figure 2:
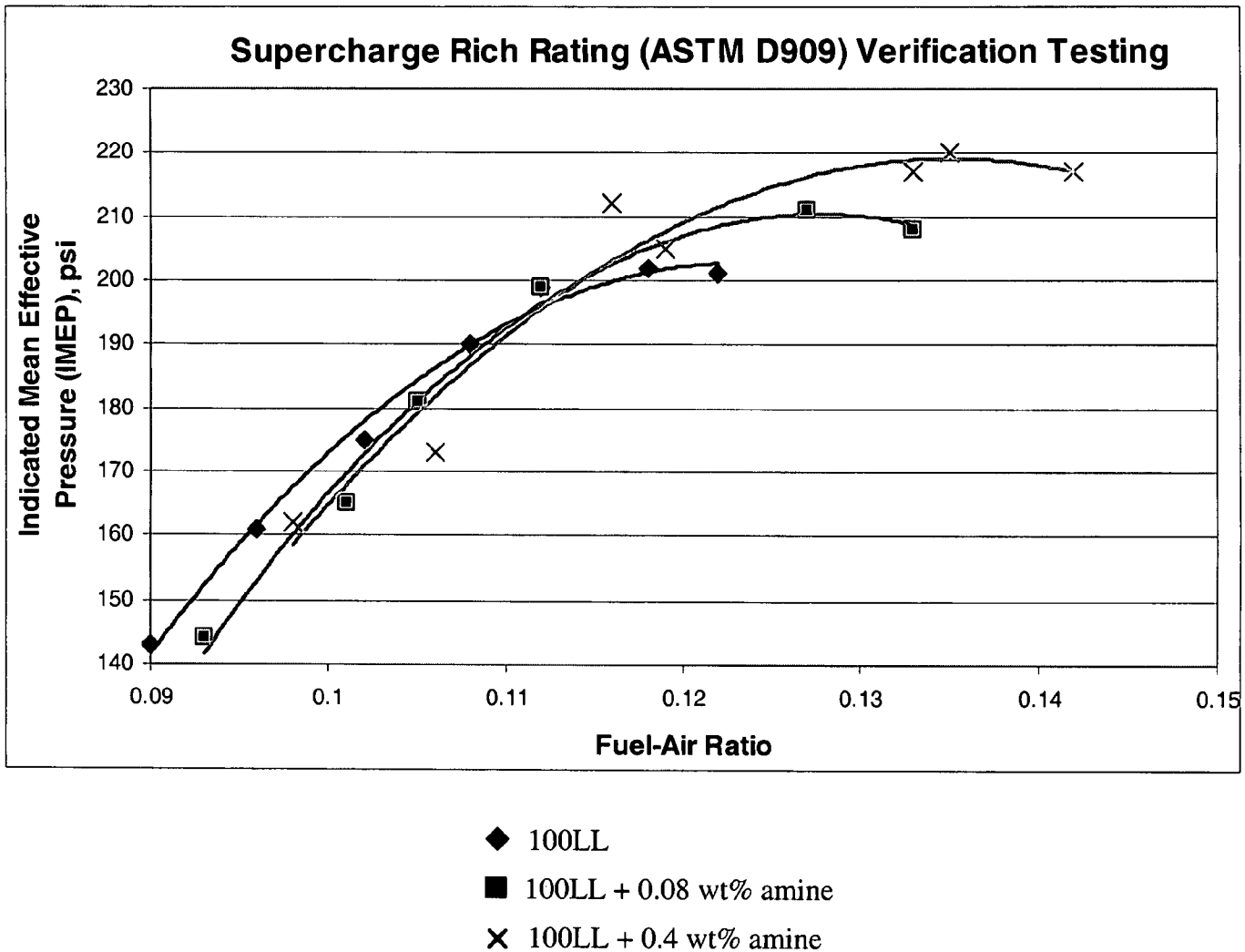
FIG. 2 is a presentation of confirmation runs of three comparative fuels using actual aviation fuel as base fuel showing that the fuels containing lead plus amine exhibit peak indicated mean effective pressures higher than that of the leaded base fuel at high fuel-air ratios (rich).

A verification test was conducted using the same 100 LL fuel per se and additized with alkylate containing 8 wt % m-toluidine in amounts sufficient to contribute 0.08 and 0.40 wt % amine to the fuel. The results are presented in FIG. 2. As is seen this confirms that the samples containing the amine component exhibited PIMEP in excess of that exhibited by the leaded fuel per se, the difference again being most pronounced at high fuel-air ratios (rich).

Example 2

The effect of adding lead (as TEL) and amine (as m-toluidine to a fuel was evaluated using isooctane as a reference fuel.

Evaluations were run to determine peak indicated mean effective pressure according to ASTM D909 on isooctane as base fuel, isooctane containing 0.14 vol % (0.2 wt %) m-toluidine, isooctane+1.25 ml TEL/gal (0.35 g lead/liter), and isooctane plus 1.25 ml TEL/gal. (0.35 g lead/liter) and 0.14 vol % (0.2 wt %) m-toluidine.

Figure 3:
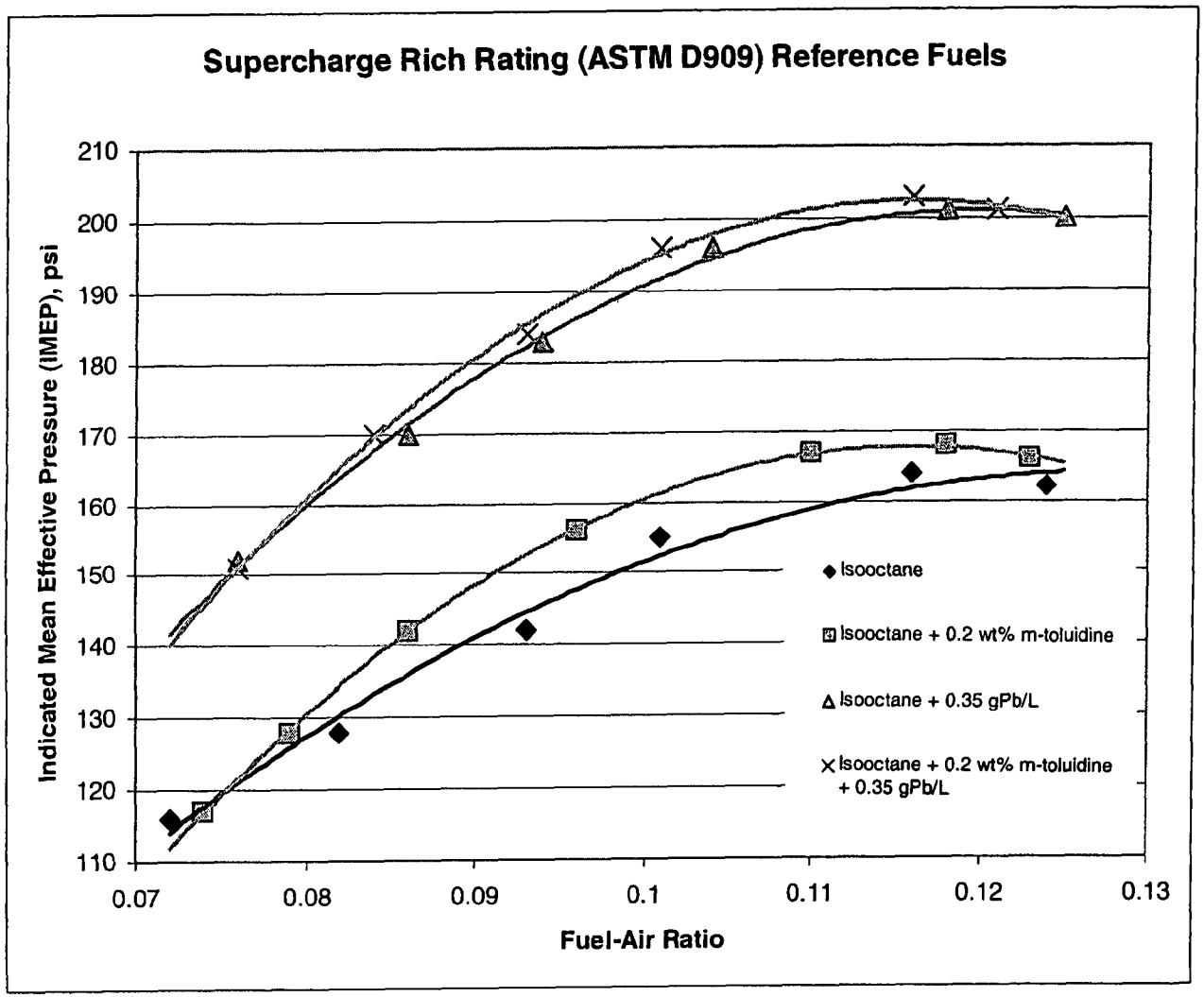
FIG. 3 is a presentation of the indicated mean effective pressure of four comparative fuels using isooctane as reference base fuel again showing that the fuel containing lead plus amine exhibits a peak indicated mean effective pressure higher than that of just the leaded isooctane at high fuel-air ratios (rich).

The results are presented in FIG. 3 which shows that the sample containing the isooctane plus TEL plus amine exhibited a PIMEP about 2 psi above the PIMEP of the isooctane plus TEL alone.

What is claimed is:

1. An improved leaded aviation fuel composition for piston driven aircraft which comprises:

(1) an aviation gasoline base fuel having an unleaded MON of at least about 90 and containing between about 0.013 to 0.6 grams lead per liter of gasoline base fuel from a lead-containing octane improver, and (2) 0.08 to 0.40 wt % of at least one aromatic amine effective to boost the peak indicated mean effective pressure as measured by ASTM D909 by at least 1 psi above the PIMEP of the leaded but unaminated base fuel, said aromatic amine having the formula $NH_2$—Ar—$(R^1)_n$ wherein $R^1$ is $C_1$-$C_{10}$ alkyl, Ar is a phenyl group and n is an integer from 0 to 3 with the proviso that $R^1$ is positioned in the meta- or para-position(s) on the aromatic ring, wherein the resulting aviation fuel composition has a peak indicated means effective pressure (PIMEP) as measured by ASTM D909 greater than about 210 psi.

2. The composition of claim 1 wherein $R^1$ is $C_1$-$C_5$ alkyl.

3. The composition of claim 1 wherein n is 1 to 2.

4. The composition of claim 1 wherein the aromatic amine is selected from the group consisting of 3,5-dimethylphenylamine, 3,4-dimethylphenylamine, 3-methylphenylamine, 3-ethylphenylamine, 4-ethylphenylamine, 4-isopropylphenylamine and 4-t-butylphenylamine.

5. A leaded aminated aviation fuel composition having a peak indicated mean effective pressure as measured by ASTM D909 of greater than about 200 psi for piston driven aircraft which comprises:

(1) an aviation gasoline base fuel having an unleaded MON of 91 to 95 and containing between about 0.013 to 0.6 grams lead per liter of gasoline base fuel of tetraethyl lead as octane improver, and (2) 0.08 to 0.40 wt % of at least one aromatic amine effective to boost the peak indicated mean effective pressure of the leaded base fuel by at least 1 psi above the PIMEP of the leaded fuel prior to the addition of the amine, said aromatic amine being of the formula $NH_2$—Ar—$(R^1)_n$ wherein $R^1$ is halogen or a combination of halogen and $C_1$-$C_{10}$ alkyl with the proviso that the alkyl group is positioned at the meta- or para-position(s) on the aromatic ring.

6. The composition of claim 5 wherein the halogen is Cl or F.

7. The composition of claim 5 wherein the PIMEP of the leaded base fuel is boosted by at least 2 psi above the PIMEP of the leaded fuel prior to the addition of the amine, and the PIMEP of the leaded aminated aviation fuel is greater than about 205 psi.

8. The composition of claim 5 wherein the PIMEP of the leaded base fuel is boosted by at least 5 psi above the PIMEP of the leaded fuel prior to the addition of the amine.

9. The composition of claim 5 wherein the PIMEP of the leaded base fuel is boosted by at least 10 psi above the PIMEP of the leaded fuel prior to the addition of the amine.

10. A method for a increasing the peak indicated mean effective pressure of leaded aviation fuel composition to about 200 psi for use in piston driven aircraft which comprises admixing with an aviation base fuel having a MON of at least 90, an amount of tetraethyl lead between about 0.013 to about 0.6 grams lead per liter of base fuel, and from about 0.08 to 0.40 wt % of one or more aromatic amines of the formula $NH_2$—Ar—$(R^1)_n$ where $R^1$ is selected from the group consisting of $C_1$-$C_{10}$ alkyl, halogen and mixtures thereof, Ar is a phenyl group and n is an integer from 0 to 3 with the proviso that when $R^1$ is alkyl it is positioned in the meta- and/or para-position(s) on the aromatic ring effective to boost the peak indicated mean effective pressure of the leaded base fuel at least 1 psi above the PIMEP of the leaded fuel prior to the addition of the amine.

11. A method for operating a piston driven aircraft at high fuel-air ratios with a leaded fuel which comprises operating the piston driven aircraft with a leaded aminated aviation gasoline base fuel having a peak indicated mean effective pressure of greater than about 200 psi containing between about 0.013 to 0.6 grams of lead per liter of gasoline base fuel of TEL and from about 0.08 to 0.40 wt % of one or more aromatic amines of the formula $NH_2$—Ar—$(R^1)_n$ where $K^1$ is selected from the group consisting of $C_1$-$C_{10}$ alkyl, halogen and mixtures thereof, Ar is a phenyl group and n is an integer from 0 to 3 with the proviso that when $R^1$ is alkyl it is positioned in the meta- and/or para-position(s) on the aromatic ring effective to boost the peak indicated mean effective pressure of the leaded base fuel at least 1 psi above the PIMEP of the leaded fuel prior to the addition of the amine, the leaded aviation gasoline fuel containing the aromatic amine having a motor octane number of at least 100.

* * * * *